US006585014B1

(12) United States Patent
Fink, Jr.

(10) Patent No.: US 6,585,014 B1
(45) Date of Patent: Jul. 1, 2003

(54) EASY OPENING FUEL DISPENSING NOZZLE

(75) Inventor: Arthur C. Fink, Jr., Londell, MO (US)

(73) Assignee: Husky Corporation, Pacific, MO (US)

( * ) Notice: Subject to any disclaimer, the term of this patent is extended or adjusted under 35 U.S.C. 154(b) by 0 days.

(21) Appl. No.: 10/222,094

(22) Filed: Aug. 19, 2002

(51) Int. Cl.[7] ..... B65B 1/04
(52) U.S. Cl. ..... 141/208; 141/206; 141/392
(58) Field of Search ..... 141/59, 206, 208, 141/392

(56) References Cited

U.S. PATENT DOCUMENTS 3,273,609 A 9/1966 Carder et al.
4,596,278 A 6/1986 Fink, Jr.
4,658,987 A 4/1987 Fink, Jr.
5,035,271 A * 7/1991 Carmack et al. ..... 141/206
5,474,115 A 12/1995 Fink, Jr.
5,522,440 A * 6/1996 Mitchell ..... 141/392
5,562,133 A 10/1996 Mitchell

* cited by examiner

*Primary Examiner*—Steven O. Douglas
(74) *Attorney, Agent, or Firm*—Paul M. Denk

(57) ABSTRACT

A fuel dispensing nozzle incorporating a lever assembly that enables a user to more easily and controllably dispense fuel through the nozzle. More particularly, the nozzle has a fuel flow path running through it, with an automatic fuel flow shutoff mechanism and a spring loaded valve assembly with an associated valve stem positioned along the fuel flow path above a lever assembly that regulates the flow of fuel through the nozzle. The lever assembly has a latch plate pivotally connected between the shutoff mechanism and a handle, such that the handle engages the valve stem to provide the user with more leverage to open the valve assembly than is available in conventional nozzle configurations.

20 Claims, 4 Drawing Sheets

EASY OPENING FUEL DISPENSING NOZZLE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates to gas dispensing nozzles and more particularly to a novel arrangement of and interrelationships between the lever that constitutes the operating handle and automatic shutoff trigger for a typical automatic fuel dispensing nozzle, to enable a user to more easily open the nozzle for the flow of fuel.

Automatic fuel dispensing nozzles are long known in the art, and are used throughout the world to enable a user to controllably regulate the flow of fuel from a storage tank into a user tank, such as a gasoline tank in an automobile. In order to avoid unnecessary and undesirable spillage of fuel, relatively strong springs are typically located within the nozzle to ensure positive closure of the nozzle's fuel flow valve or poppet valve when the user is no longer dispensing fuel. The strength of such springs require that a substantial force be applied to the nozzle fuel valve in order to overcome the spring's bias and open the valve for the dispensing of fuel. Accordingly, it is common in the industry to link the nozzle handle to the poppet valve through a valve stem and orient the nozzle handle as a lever to reduce the amount of force necessary to open the valve. When the handle is operated, it contacts the valve stem and opens the valve. The distance from the lever pivot to the valve stem is typically equal to approximately one-third the distance to the handgrip portion of the handle. This means that a valve that requires 30 pounds of force to open will require a squeeze force of approximately 10 pounds at the handgrip portion of the handle to dispense fuel. It is desirable to reduce this squeeze force.

While it is possible to reduce the squeeze force necessary to open the poppet valve by lengthening the grip portion of the handle, this poses undesirable difficulties. Although extending the grip portion of the handle may not require substantial redesign of the nozzle body, it would make the nozzle awkward and unwieldy.

Hence, it would be desirable to move the pivot point along the handle to reduce the threshold squeeze pressure, yet do so without requiring substantial changes to the design of the nozzle.

The present invention is readily adaptable to numerous shapes and sizes, and may be constructed of many materials, such as fibers, plastics and metals.

BRIEF SUMMARY OF THE INVENTION

The present invention resides in an automatic fuel dispensing nozzle that comprises a body with a fuel flow path through the body, and an inlet at one end and an outlet at the other end of the fuel flow path. A valve assembly is positioned along the fuel flow path that includes a spring-loaded valve with an axially movable valve stem that opens the valve to allow fuel flow through the nozzle when the valve stem moves upward against the spring bias. The nozzle can include an automatic fuel flow shutoff mechanism. A lever assembly engages the valve stem and the shutoff mechanism. The lever assembly includes a latch plate, pivotally connected at one end to the nozzle body (or shutoff mechanism if present), and a handle that engages the valve stem. The handle is pivotally connected to the latch plate between the ends of the latch plate.

Preferably, the handle includes a grip end, a central portion and a link. The handle link engages the valve stem and has a first end and a second end, such that the link first end is pivotally connected to the handle central portion, the central portion is connected to the grip, and the link second end is pivotally connected to the latch plate. The nozzle link is positioned to engage the valve stem along its length.

In addition, the nozzle preferably includes a hand guard surrounding the lever assembly and a spring loaded lock plate that pivotally connects to the handle and is capable of releasably engaging the latch plate to hold the valve opened. The top of the latch plate has a series of ridges that hold the lock plate in engagement with the latch plate when the lock plate is pressed down upon the latch plate and the latch plate is engaged with the guard.

Hence, the present invention provides a simple to operate mechanism that reduces the force necessary for a user to apply to the handle of a fuel dispensing nozzle to open the fuel flow valve and allow fuel to flow through the nozzle. This enables the user to more easily and precisely regulate the amount of fuel the user wishes to dispense through a fuel dispensing nozzle, without the need for a major modification to the conventional nozzle design.

The present invention is readily adaptable to numerous shapes and sizes, and may be constructed of many materials, such as fibers, plastics and metals.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
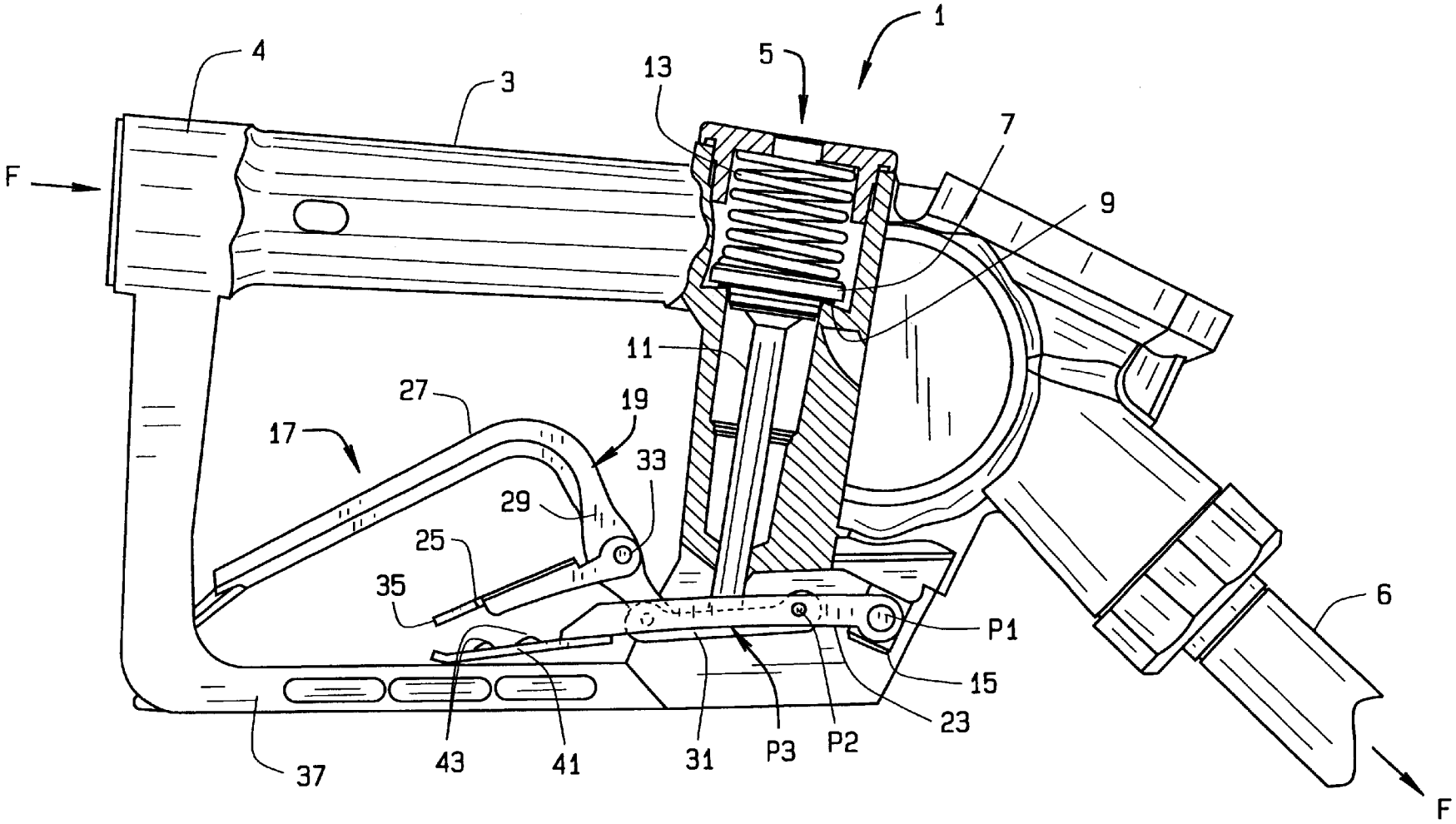
FIG. 1 is a partial cut away side elevation of an automatic fuel dispensing nozzle containing the preferred embodiment of the novel lever system, wherein the nozzle handle is in its lowered position, and the poppet valve is closed, readied for usage by the customer to raise the lever handle to dispense gas.

A fuel dispensing nozzle of the present invention is indicated generally at 1 (FIGS. 1, 2, 3 and 4). Referring to FIG. 1, the nozzle 1 includes a housing 3 of cast aluminum, or other suitable material, through which runs a fluid flow path F. The housing 3 has an inlet 4 near the rear of the nozzle 1 and an outlet 6 near the front of the nozzle. A poppet valve assembly 5 is disposed within the flow path F and includes a valve body 7 that cooperates with a main valve seat 9 in the flow path F.

The valve assembly 5 also includes a valve stem 11 that descends from the assembly and through the housing 3, and a spring 13 that is held in compression between the top of the valve body 7 and the housing 3 above the assembly to bias the valve body against the valve seat 9. The spring 13 thereby exerts a force against the top of the valve body 7 to bias the valve closed.

Preferably the nozzle 1 includes an automatic shutoff mechanism (not shown in full) to stop the flow of fuel when the vehicle's fuel tank if filled. One such shutoff mechanism is described in U.S. Pat. No. 4,658,987, which is incorporated herein by reference. The shutoff mechanism includes a valve stem, such as the springloaded automatic shutoff valve stem 15 (FIGS. 1, 2, 3 and 4 ) that protrudes from the housing 3 forward of and below the valve assembly 5. The shutoff mechanism also includes vapor recovery components (not shown) within the nozzle body such as those disclosed in U.S. Pat. No. 5,474,115, which also is incorporated herein by reference.

Figure 2:
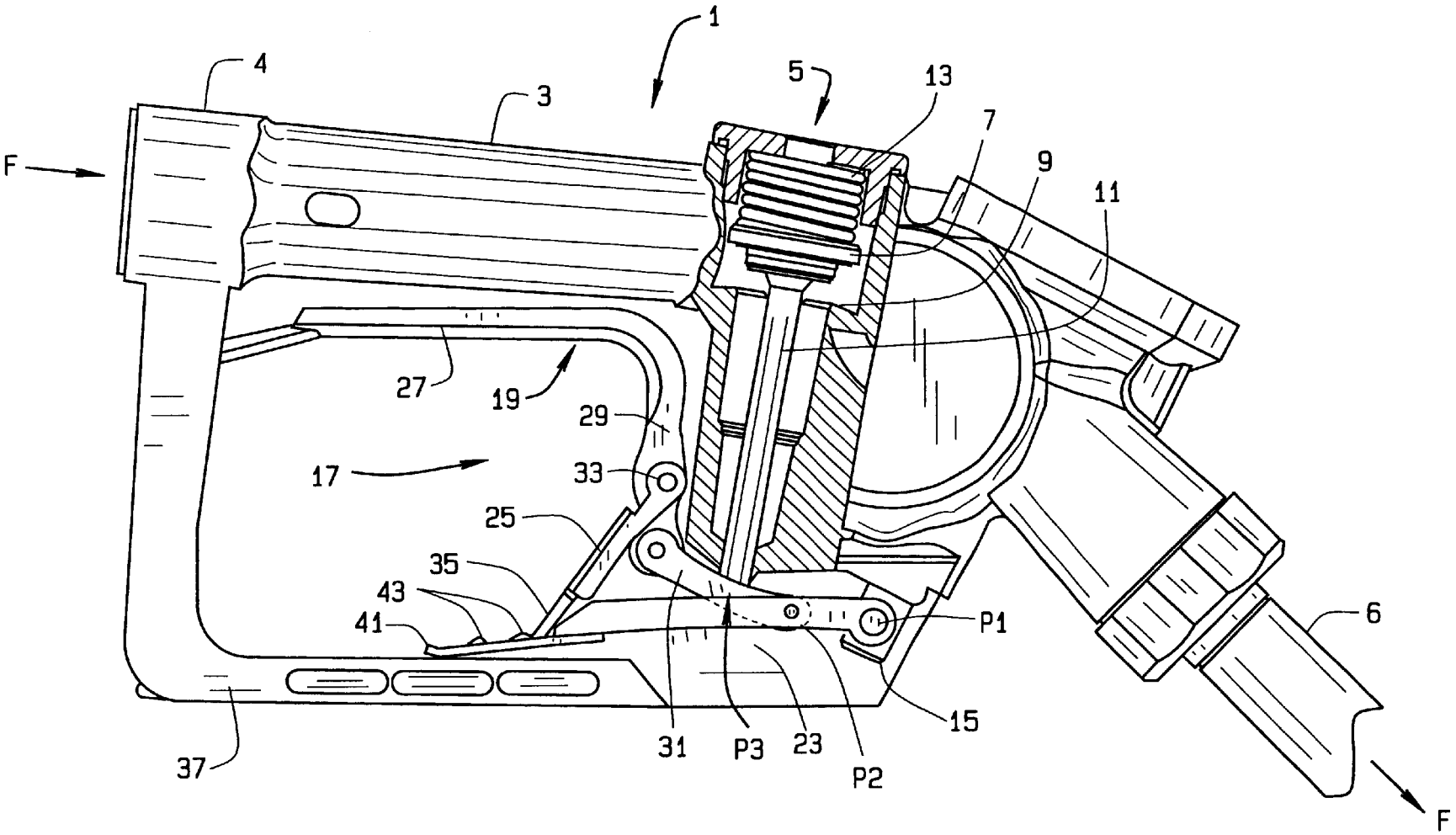
FIG. 2 is a partial cut away side elevation of the automatic fuel dispensing nozzle, of FIG. 1, wherein the nozzle handle has been raised, with the automatic shutoff mechanism still activated, but the poppet valve now being opened, as when routinely dispensing gasoline.
Figure 3:
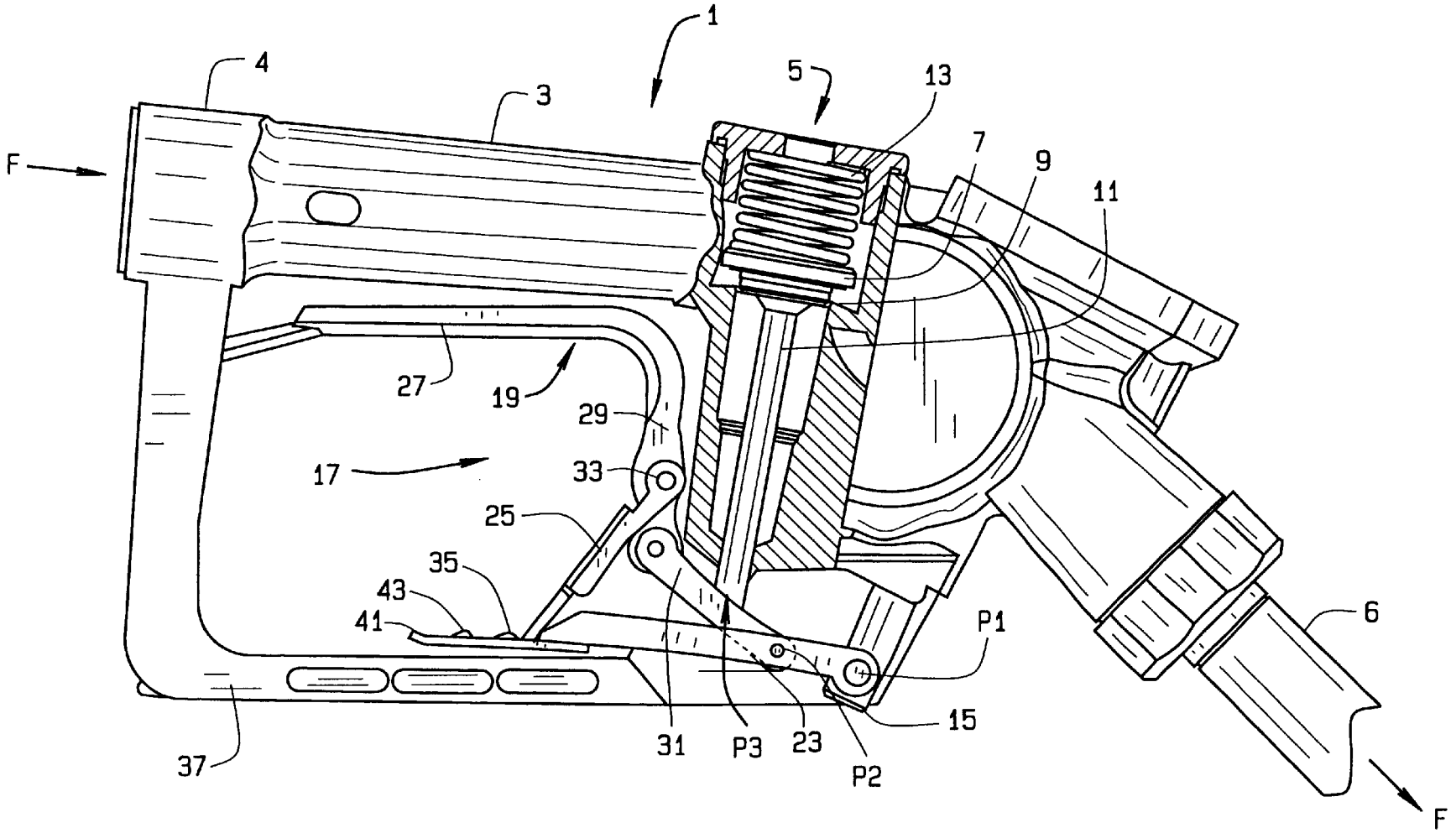
FIG. 3 is a partial cut away side elevation of the fuel dispensing nozzle of FIG. 1, wherein the nozzle handle is still raised, but the automatic shut-off has been deactivated and lowered, in order to provide an immediate decent of the poppet valve to shut off the further dispensing of gasoline.
Figure 4:
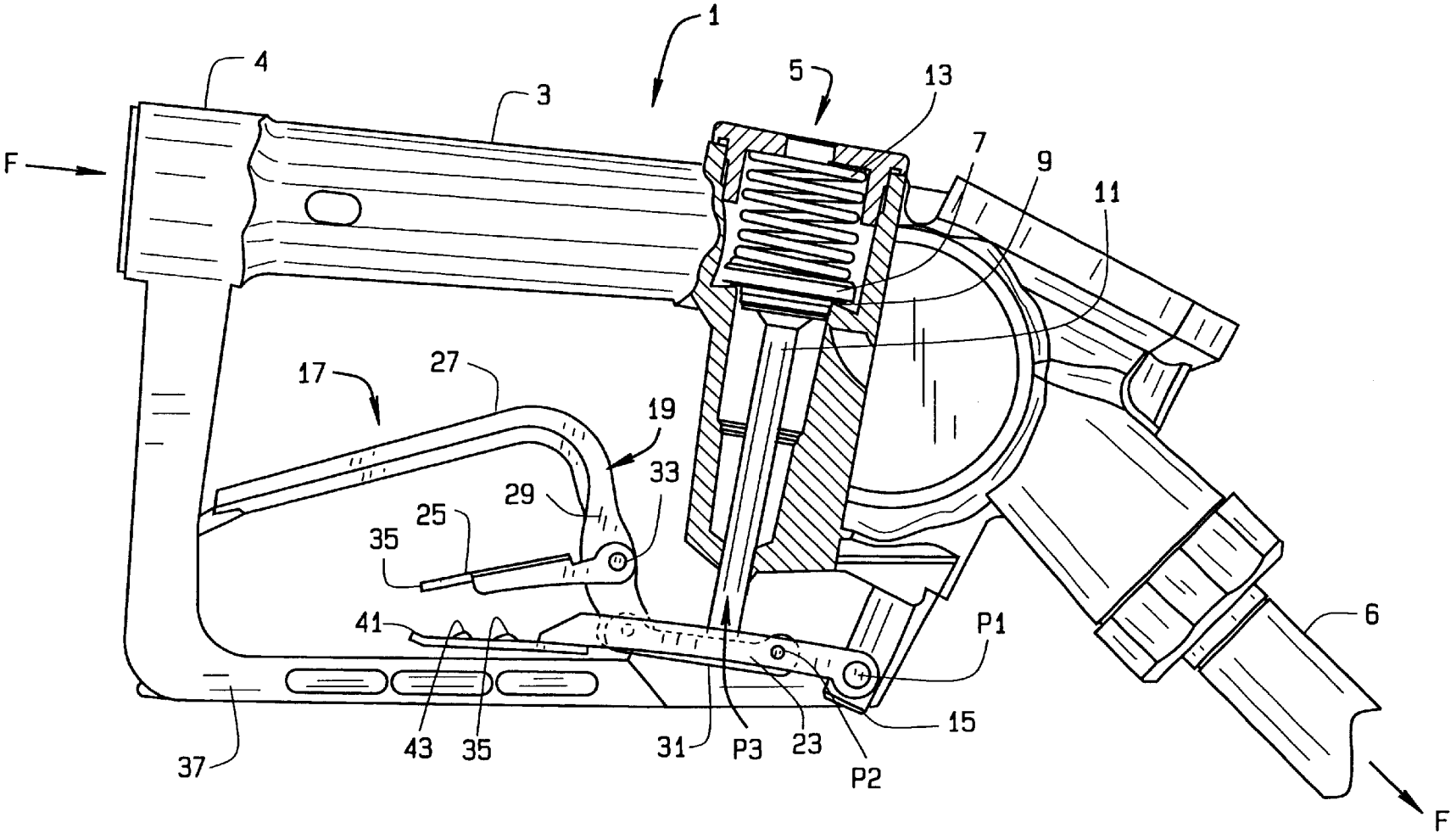
FIG. 4 is a partial cut away side elevation of the fuel dispensing nozzle of FIG. 1, wherein the nozzles ability to dispense gas has been curtailed, and both the automatic shutoff and handle are lowered as when not dispensing, although the automatic shut-off will instantaneously elevate, to reset the nozzle for the next dispensing of gasoline by the customer.

A lever assembly 17 is likewise positioned outside the housing 3, below the valve assembly 5. The lever assembly 17 may be used for newly manufactured fuel dispensing nozzles or may be used as a replacement for valve assemblies in existing nozzles. The lever assembly 17 comprises a handle 19, a latch plate 23 and a lock plate 25. The handle 19 is generally "S" shaped, having a grip portion 27 at the rearmost end, a central portion 29, and a forward portion 31. Preferably, the forward portion 31 comprises a link that is pivotally attached to the central portion 29 (FIG. 2). The handle grip 27 and central portion 29 comprise a unitary piece having a generally "L" shape. The lock plate 25 comprises a first end 33 pivotally attached to the handle central portion 29, and a free end 35 capable of engaging the top of the latch plate 23. A nozzle guard 37 is fixedly attached at each end to the housing 3 and surrounds the lever assembly 17.

The foremost end of the latch plate 23 pivotally attaches to the shutoff valve stem 15 at a point P1. Opposite the point P1, the latch plate 23 has a free end 41 that engages the lower portion of the guard 37. A series of ridges 43 are formed along the top of the latch plate 23 near the free end 41. At a point P2, approximately one fifth the distance from the point P1 to the free end 41 of the latch plate 23 in the preferred embodiment, the forward end of the handle link 31 pivotally attaches to the latch plate 23. Approximately midway along the link 31 of the handle 19, the bottom of the valve stem 11 engages the handle 19 at a point P3, such that the point P2 lies between the points P1 and P3.

The handle 19 is movable between a lower position (FIG. 1), in which the base of the handle link 31 rests against the lower portion of the guard 37, and an upper position (FIG. 2), in which the grip 27 is in close proximity to the inlet 4 of the housing 3, and the valve body 7 is opened against the force of the spring 13.

When the handle 19 is in its lower position (FIG. 1), the latch plate 23 is likewise in its lower position and allows the spring 13 to force the valve body 7 to seal against the valve seat 9 to prevent the flow of fuel along the fuel flow path F through the nozzle 1, and also allows the forward end of the latch plate 23 to rotate upward about the point P2 and such that the shutoff valve stem 15 is in its upward position.

When the handle 19 is raised toward its upper position (FIG. 2), the handle link 31 pivots about the point P2 and pushes up on the valve stem 11 which in turn raises the valve body 7 off of the valve seat 9 and allows the flow of fuel through the valve assembly 5 between the inlet 4 and outlet 6 along the fuel flow path F. When the handle 19 is in its upper position (FIG. 2), the free end 35 of the lock plate 25 can be rotated downward to engage the ridges 43 of the latch plate 23. The length and configuration of the lock plate 25 is such that its free end 35 can be set to rest against one of the ridges 43 along the top of the latch plate. Upon release of the grip 19, the lock plate 25 will maintain the handle link 31 in its raised position against the force of the valve spring 13, thus enabling the valve 5 to remain in its open position to allow fuel to flow through the fuel flow path F without requiring the user to continue to hold the handle in its upper position. The lock plate 25 can readily be released from its locked engagement with the latch plate 23 by raising the grip 27 upward and rotating the lock plate 25 upward away from the latch plate. Of course, the lock plate 25 may be spring loaded to automatically direct the lock plate 25 away from the latch plate 23 upon mutual disengagement.

As is known, when the fuel tank is full, the shutoff mechanism will cause the shutoff valve stem 15 to spring downward (FIG. 3), which in turn releases the lock plate free end 35 from the latch plate ridges 43, thereby allowing the handle 19 to return to its lower position as the shutoff valve stem 15 remains for a moment in its downward position, thereby lowering the latch plate 23 and handle link 31 to close the poppet valve 5.

Instantaneously, though, the automatic shutoff mechanism, and its internal springs (not shown), raises the shutoff valve stem 15 back up into its operative position, as shown in FIG. 1, and the handle remains in this condition while it is stored in the dispenser, awaiting the next customer to apply the handle to the fill pipe of his/her vehicle gasoline tank, in preparation for subsequent fuel dispensing. When the automatic shutoff springs back upwardly, as described, the handle then has the relationship and component positioning, once again, as shown in FIG. 1.

As can be appreciated, the compressive force of the spring 13 pressing against the top of the valve body 7 must be overcome in order to raise the valve stem 11. Further, the compressive force is necessarily a strong force in order to sealingly press the valve body 7 against the valve seat 9 to prevent the undesirable leakage of fuel through the valve assembly 5 when the poppet valve is closed. It is well understood that a lever may be used to reduce the amount of applied force required to overcome a countervailing force.

In a prior nozzle, as can be seen in U.S. Pat. No. 5,474,115, which is incorporated herein by reference, the handle pivotally attaches to both nozzle's automatic shutoff valve stem and latch plate. In such a configuration there is no pivot point P2 as in the nozzle 1. An example of a conventional type nozzle is shown in U.S. Pat. No's. 3,273,609; 5,562,133; and 4,658,987. In the conventional nozzle configuration, then, the force A that must be applied by the handle to raise the valve stem 11 is determined by multiplying the spring force f by the ratio of the distance from a common point along the grip 27 to the point P1 divided by the distance between the points P1 and P3. This can be expressed as follows:

$$A = f * \left(\frac{y}{x+y}\right)$$

Where

A=the force necessary to apply to the grip 27 to overcome compressive force f;

f=the compressive force applied by the spring 13 to the valve body 9;

x=the distance from a common point on the grip to the point P3; and y=the distance between points P1 and P3.

In the nozzle 1, however, the force B that must be applied by the handle to raise the valve stem 11 is determined by multiplying the spring force f by the ratio of the distance from a common point along the grip 27 to the point P2 divided by the distance between the points P2 and P3. This can be expressed as follows:

$$B = f * \left(\frac{z1}{x+z1}\right)$$

Where

B=the force necessary to apply to the grip 27 to overcome compressive force f;

f=the compressive force applied by the spring 13 to the valve body 9;

x=the distance from a common point on the grip to the point P1;

z1=the distance between the points P2 and P3;

z2=the distance between the points P2 and P1; and y=z1+z2.

By comparing both of these equations, it can be readily seen that A=B when z2 approaches a value of zero (0) as a limit (leading to the point where z1=y), and that A>B as long as z2>0. Hence, so long as the distance z2 between the points P1 and P2 is greater than zero, as the design of the present invention dictates, the force needed to overcome the spring force f will always be less than in the conventional nozzle design.

The present invention, therefore, enables a user to control the dispensing of fuel through the nozzle 1 with less effort than in a conventional nozzle design. This enables the user to more easily and accurately dispense a desired quantity of fuel through the nozzle.

Other variations on the basic apparatus are also available. For example, any number of well-understood devices may be used to retain the handle 19 in its upper position other than the lock plate 25, including, but not limited to latches, screws, hooks, pins and rods. Further, the lock plate 25, or its counterparts, could be located at any number of locations along the handle 19. The valve stem 11 may be pivotally attached to the handle 19. The link 31 can be integrally formed with the handle grip 27 and central portion 29. The handle link 31 may be pivotally connected directly to the grip 27. The latch plate 23 may be pivotally attached to some part of the nozzle 1 other than the shutoff valve stem 15.

Similarly, in a nozzle configuration with no automatic shutoff mechanism, the handle 19 may be pivotally attached to some part of the nozzle 1 other than the latch plate 23. The poppet valve stem 11 can engage the handle link 31 at any desired location between the ends of the link.

Additionally, any number of resilient compressive devices may be substituted for the spring 13, including, for example, any of the multitude of varying spring designs, spring metal plates, and plugs or tubes made of a resilient material such as rubber. Further, the dimensions of the apparatus can vary significantly, including, but not limited to, widening or thinning of each of the components together or relative to one another, so long as the general operation of the apparatus is not defeated. Finally, each of the components of the invention can be manufactured from a variety of materials, including, but not limited to, plastics and metals, so long as the apparatus maintains the same functionality and the necessary structural integrity.

As various changes could be made in the above constructions without departing from the scope of the invention, it is intended that all matter contained in the above description or shown in the accompanying drawings shall be interpreted as illustrative and not in a limiting sense.

What is claimed is:

1. An automatic fuel dispensing nozzle comprising a body, a fuel flow path within the body, an inlet at a first end of the fuel flow path, an outlet at a second end of the fuel flow path, a valve assembly positioned along the fuel flow path and being movable between a closed position in which fuel flow through the nozzle is prevented and an opened position in which fuel flows through the nozzle, an axially movable valve stem that engages said valve to move the valve between its opened and closed positions, an automatic fuel flow shutoff mechanism, and a lever assembly engaged with the valve stem, the lever assembly comprising:

a. a latch plate having a first end and a second end, said first end being pivotally connected to the shutoff mechanism; and b. a handle having a first end and a second end, the first end being pivotally connected to the latch plate between the first and second ends of said latch plate, the handle engaging the valve stem between the first and second ends of said handle.

2. The nozzle of claim 1, wherein the handle comprises a grip portion and a link, the handle link engaging the valve stem and having a first end and a second end, the first end of the handle link being pivotally connected to the grip portion and the second end of the handle link being pivotally connected to the latch plate.

3. The nozzle of claim 2, wherein the handle link engages the valve stem between the first and second ends of said link.

4. The nozzle of claim 2, wherein the handle further comprises a central portion, said handle central portion being positioned between the grip portion and the link, the first end of said handle link being pivotally connected to said handle central portion.

5. The nozzle of claim 1, further comprising a lock plate, said lock plate being pivotally connected to the handle at a first end of said lock plate, and capable of releasably engaging the latch plate at a second end of said lock plate.

6. The nozzle of claim 5, further comprising a guard, said guard being connected to the nozzle body and positioned about the lever assembly, the second end of the latch plate being capable of engaging the guard.

7. The nozzle of claim 6, wherein the top of the latch plate comprises at least one ridge, said ridge being oriented on the latch plate to positionally restrain the lock plate upon engagement of the lock plate with the latch plate to maintain the handle in a raised position.

8. The nozzle of claim 1, wherein the valve assembly is spring loaded and downwardly biased against the handle.

9. The nozzle of claim 1, further comprising means for vapor recovery.

10. A lever assembly for an automatic fuel dispensing nozzle, the nozzle comprising a body, a fuel flow path within the body, an inlet at a first end of the fuel flow path, an outlet at a second end of the fuel flow path, a valve assembly positioned along the fuel flow path and being movable between a closed position in which fuel flow through the nozzle is prevented and an opened position in which fuel flows through the nozzle; and an axially movable valve stem that engages said valve to move the valve between its opened and closed positions; said lever assembly engaging said valve stem to move said valve from its closed to opened positions; the lever assembly comprising:

a. a latch plate having a first end and a second end, said first end being operatively pivotally connected to the shutoff mechanism; and b. a handle having a first end and a second end, the first end being pivotally connected to the latch plate between the first and second ends of said latch plate, the handle engaging the valve stem between the first and second ends of said handle.

11. The lever assembly of claim 10, wherein the handle comprises a grip portion and a link, the handle link engaging the valve stem and having a first end and a second end, the link first end being pivotally connected to the grip and the link second end being pivotally connected to the latch plate.

12. The lever assembly of claim 11, wherein the handle link engages the valve stem between the first and second ends of said link.

13. The lever assembly of claim 11, wherein the handle further comprises a central portion, said handle central portion being positioned between the grip portion and the handle link, the link first end being pivotally connected to said handle central portion.

14. The lever assembly of claim 10, further comprising a lock plate, said lock plate being pivotally connected to the handle and capable of releasably engaging the latch plate.

15. The lever assembly of claim 14, wherein the nozzle further comprises a guard, said guard being connected to the nozzle body and positioned about the lever assembly, the second end of the latch plate being capable of engaging the guard.

16. The lever assembly of claim 15, wherein the top of the latch plate has a ridge, said ridge being oriented on the latch plate to positionally restrain the lock plate upon engagement of the lock plate with the latch plate.

17. The lever assembly of claim 16, wherein the valve assembly is spring loaded and downwardly biased against the handle.

18. An automatic fuel dispensing nozzle comprising a body, a fuel flow path within the body, an inlet at a first end of the fuel flow path, an outlet at a second end of the fuel flow path, a valve assembly positioned along the fuel flow path and being movable between a closed position in which fuel flow through the nozzle is prevented and an opened position in which fuel flows through the nozzle, an axially movable valve stem that engages said valve to move the valve between its opened and closed positions, and a lever assembly engaged with the valve stem, the lever assembly comprising:

a. a latch plate having a first end and a second end, said first end being operatively pivotally connected to the shutoff mechanism; and b. a handle having a grip portion and a link portion, the link being pivotally connected at one end to the latch plate between the first and second ends of said latch plate; the grip portion being pivotally connected to a second end of the link; and the link engaging the valve stem between the first and second ends of said link.

19. The nozzle of claim 18, further comprising vapor recovery means.

20. A conventional fuel dispensing nozzle comprising a body, a fuel flow path within the body, an inlet at a first end of the fuel flow path, an outlet at a second end of the fuel flow path, a valve assembly positioned along the fuel flow path and being movable between a closed position during which fuel flow through the nozzle is prevented, and then opens to a position in which fuel flows through the nozzle, a movable valve stem that engages said valve to move the valve between its opened and closed positions, and a lever assembly engaged with the valve stem, a handle guard connecting with the nozzle body, and locating the lever assembly within the same, the lever assembly comprising;

a. a latch plate having a first end and a second end, said first end being operatively pivotally connected to the handle guard; and b. a handle having a grip portion and a link portion, the link being pivotally connected at one end to one of the latch plate and handle guard, the grip portion of the handle being pivotally connected to a second end of the link; and the link engaging the valve stem between the first and second ends of said link, to open the valve assembly upon raising of the handle of the nozzle during dispensing.

* * * * *